US009173528B1

(12) United States Patent
Shrewsbury

(10) Patent No.: US 9,173,528 B1
(45) Date of Patent: Nov. 3, 2015

(54) DISABILITY SHOWER WITH AIR PURGE SYSTEM

(76) Inventor: William R. Shrewsbury, Overland Park, KS (US)

( * ) Notice: Subject to any disclaimer, the term of this patent is extended or adjusted under 35 U.S.C. 154(b) by 1087 days.

(21) Appl. No.: 13/230,226

(22) Filed: Sep. 12, 2011

Related U.S. Application Data

(63) Continuation-in-part of application No. 12/609,471, filed on Oct. 30, 2009, now Pat. No. 8,281,428.

(51) Int. Cl.
*A47K 3/022* (2006.01)
*A47K 3/12* (2006.01)

(52) U.S. Cl.
CPC ..... *A47K 3/022* (2013.01); *A47K 3/122* (2013.01)

(58) Field of Classification Search
CPC ..... A47K 3/006; A47K 3/122; A47K 3/12
USPC ..... 4/601, 604, 611, 596, 567, 571.1, 578.1
See application file for complete search history.

(56) References Cited

U.S. PATENT DOCUMENTS 4,246,926 A * 1/1981 Morello ..... 137/209
4,460,126 A 7/1984 Gates et al.
4,658,464 A 4/1987 Sharp
4,880,159 A 11/1989 Coffey
5,012,535 A * 5/1991 Klotzbach ..... 4/541.2
5,728,220 A 3/1998 Curcuri et al.
5,953,770 A * 9/1999 Kitamura ..... 4/601
5,978,983 A * 11/1999 Queen et al. ..... 4/556
6,134,722 A * 10/2000 Lowry et al. ..... 4/541.1
6,227,228 B1 5/2001 Fullenbach
6,321,773 B1 * 11/2001 Ramsby ..... 137/209
6,427,929 B1 8/2002 Nguyen et al.
7,364,053 B2 4/2008 Ophardt
7,878,420 B2 2/2011 Thomas et al.
2006/0219807 A1 10/2006 Fulkerson et al.
2010/0176251 A1 7/2010 Fulkerson et al.

* cited by examiner

*Primary Examiner* — Huyen Le
(74) *Attorney, Agent, or Firm* — Erickson Kernell Derusseau & Kleypas, LLC

(57) ABSTRACT

A shower unit includes a water delivery system having a main water line and a plurality of branches served by the main water line. Each branch terminates in one or more nozzles. A purge line selectively communicates compressed air into the main water line. Water is purged from the water delivery system by shutting off water flow into the main water line and introducing compressed air into the main water line through the purge line. Each of the branch valves is opened in sequence while keeping the remainder of the branch valves closed, allowing the compressed air to force any water in the respective branch out through the respective at least one output nozzle. The previously opened branch valve is then closed and the purging process is repeated for each successive branch.

24 Claims, 7 Drawing Sheets

DISABILITY SHOWER WITH AIR PURGE SYSTEM

This application is a Continuation In Part of application Ser. No. 12/609,471 filed Dec. 30, 2009.

BACKGROUND OF THE INVENTION

1. Field of the Invention

The present invention relates to the field of bathing apparatuses for disabled persons, and in particular to a disability shower which allows a disabled person to shower in a seated position while cleaning all body surfaces including those body surfaces normally inaccessible when seated.

2. Description of the Related Art

Taking a shower is a regular, daily activity for most people. For those who are disabled, elderly or otherwise physically challenged, including disabled veterans, however, standing for a shower can be difficult or impossible. Taking a shower while seated, such as by using a simple shower chair, can be problematic because the body surfaces upon which the person is seated, such as the buttocks and backs of the thighs, are obscured by the chair and made difficult to clean. This situation is especially difficult for the more seriously disabled who are unable to shower themselves and must be bathed by an assistant. Manipulating the disabled person on a shower chair to clean all body surfaces can be physically demanding for the assistant and hazardous for the disabled person who is subject to fall or topple over during the process.

What is needed is a shower system which allows a person to shower while in a seated position, but which provides a mechanism for exposing all body surfaces, including those body surfaces which are normally obscured while sitting. Preferably, the system would also allow the user to be showered automatically with minimal input from the user or from an assistant.

SUMMARY OF THE INVENTION

The present invention is a shower unit having a shower seat comprised of moveable seat pads. Each seat pad is moveable between an extended position wherein the pad is in contact with the body of a user sitting on the seat and a retracted position wherein the pad is spaced away from the user's body. When a pad is in the retracted position, the body surface that would normally be occluded by the pad becomes accessible to spray from a nozzle so that the body surface can be cleaned. While any one pad is in the retracted position, the user is supported on enough of the other seat pads to remain in a stable sitting position. Additional support for the user is provided by grab bars on opposed sides of the shower seat.

The spray nozzles used to wash the body surfaces exposed by retraction of the seat pads may be mounted in the seat pads themselves, or may be mounted in the shower seat proximate to the pads. If the nozzles are mounted in the seat pads, they can be controlled to spray only when the pads move out of the extended position so that there is clearance between the nozzles and the body surface.

The shower unit is preferably automatically controlled to move the seat pads and turn the spray nozzles off and on at the correct times. Onboard supplies of soap or body wash are provided to be mixed with water for a wash cycle which is followed by a rinse. The shower unit also includes one or more shampoo nozzles directed at the top of the user's head and other spray nozzles strategically located to provide full body cleansing.

In order to prevent the build-up of mold and bacteria in the water lines of the shower unit, they should preferably be thoroughly purged of water and cleaning agents such as shampoo and body wash after each use. The shower unit therefore includes the capability of automatically rinsing each branch of its water system with clean water to remove residual cleaning agents and then automatically purging each branch with compressed air to remove the remaining standing water. Both the rinsing and purging processes are performed sequentially starting with the lines serving the highest nozzles and working downward toward the lines serving the lowest nozzles.

DETAILED DESCRIPTION OF THE PREFERRED EMBODIMENTS

Figure 1:
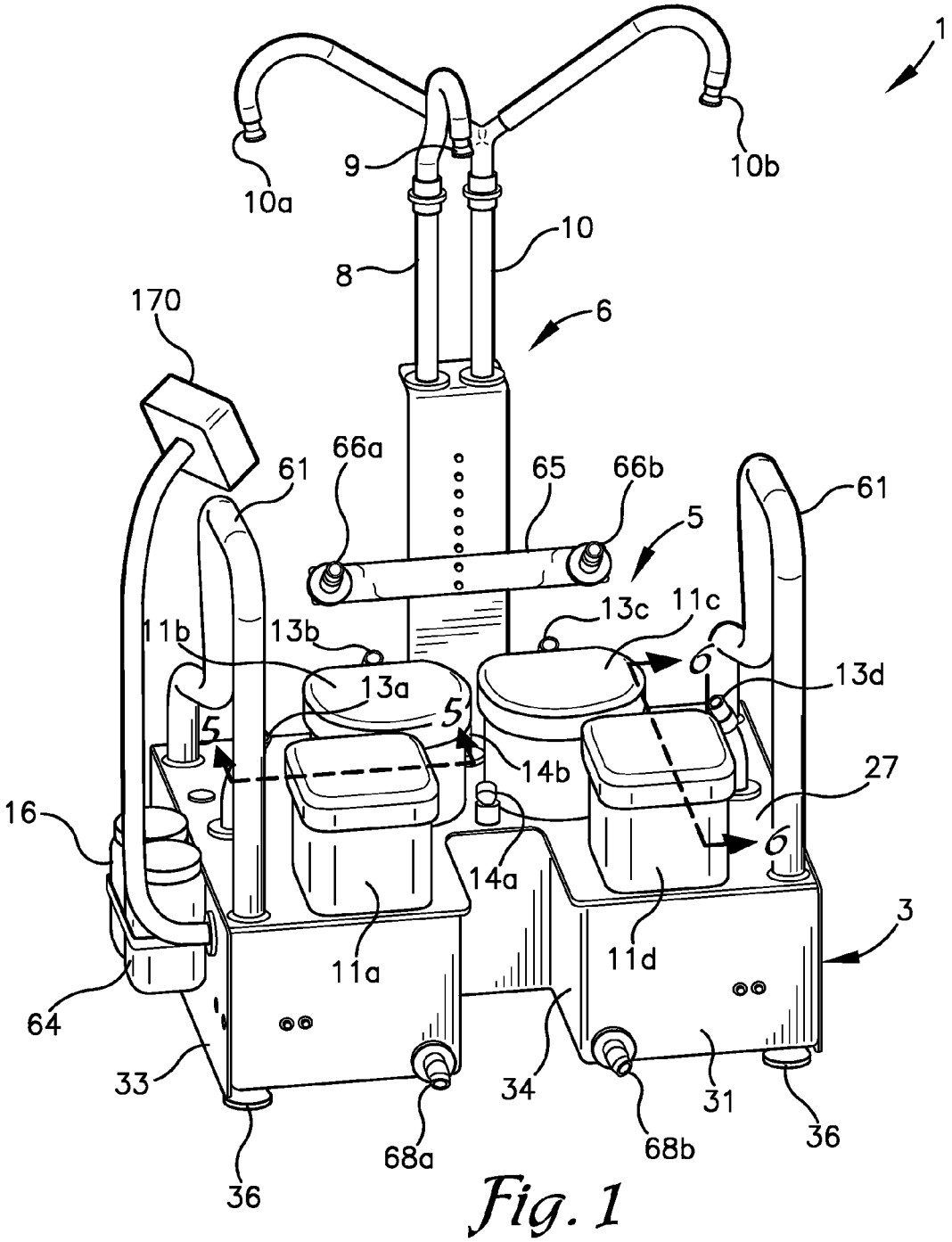
FIG. 1 is a perspective view of a shower unit according to the present invention.
Figure 2:
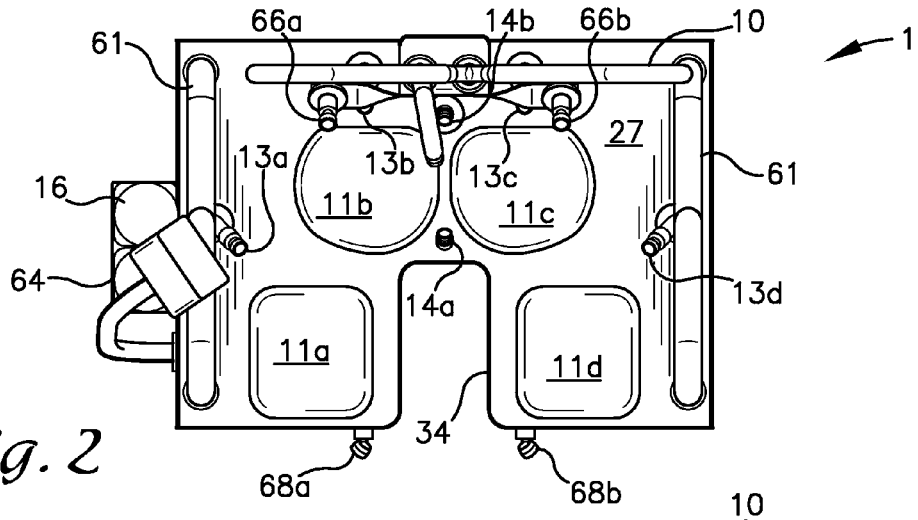
FIG. 2 is a top plan view of the shower unit.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIGS. 1-4, the reference number 1 generally designates a disability shower unit according to the present invention. The shower unit 1 is designed to be easily installed in an existing shower stall and includes a base 3, a shower seat 5 mounted on an upper surface of the base 3 and a generally vertical back support 6. The back support 6 extends upwardly from the base 3 proximate the back side thereof. A shampoo assembly 8 having at least one shampoo nozzle 9 is mounted to the back support 6 in position for the shampoo nozzle 9 to spray downwardly on the head of a user seated on the shower seat 5. Also mounted on the back support 6 is a torso spray assembly 10 having a pair of laterally spaced torso nozzles 10*a* and 10*b* positioned to spray toward the shoulders, back and chest of the user.

Figure 7:
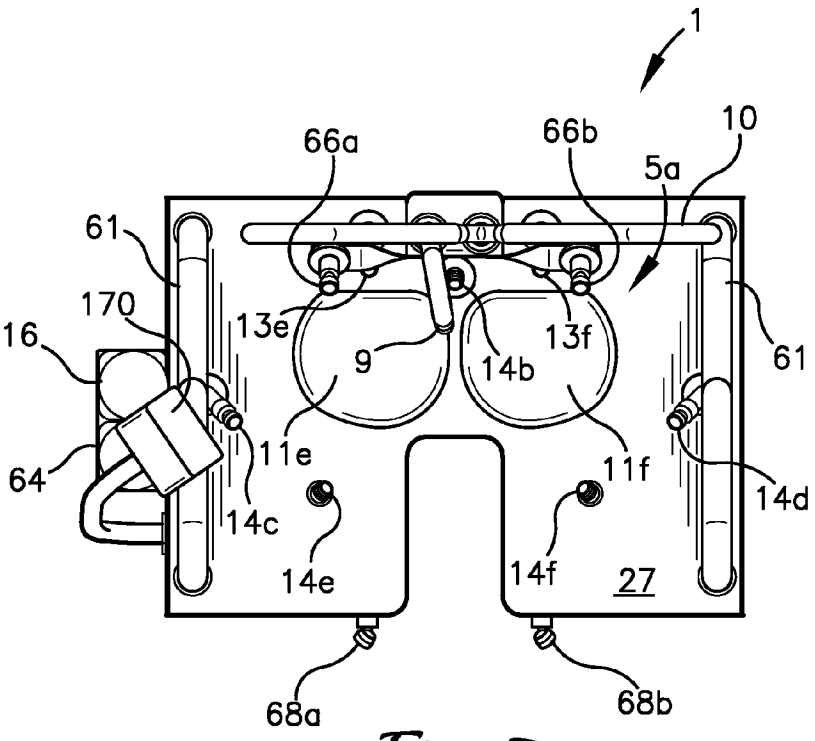
FIG. 7 is a top plan view of an alternative embodiment of the shower unit.

The shower seat 5 includes a plurality of moveable seat pads 11. Four pads 11*a*-11*d* are shown in FIGS. 1-4, however it is to be understood that more or fewer than four pads 11 could be used. For example, the unit 1 may be customized for an individual user by adding extra pads 11 for a taller user or by removing pads 11 for a user who is an amputee. A shower seat 5*a* with two pads 11*e* and 11*f* for supporting only the buttocks of a user is shown in FIG. 7.

Each of the pads 11 is independently moveable toward and away from a user seated on the shower seat 5 between an extended position and a retracted position. In the extended position of each of the pads 11, the respective pad 11 acts to support the user. In the retracted position, the respective pad 11 is spaced away from the user who is then supported by the pad or pads 11 which remain in the extended position. For example, when pad 11*a* is in the extended position it acts in combination with at least some of the pads 11*b*-11*d* to support the user. When the pad 11*a* is in the retracted position, the user is supported by pads 11*b*-11*d*.

Figure 6:
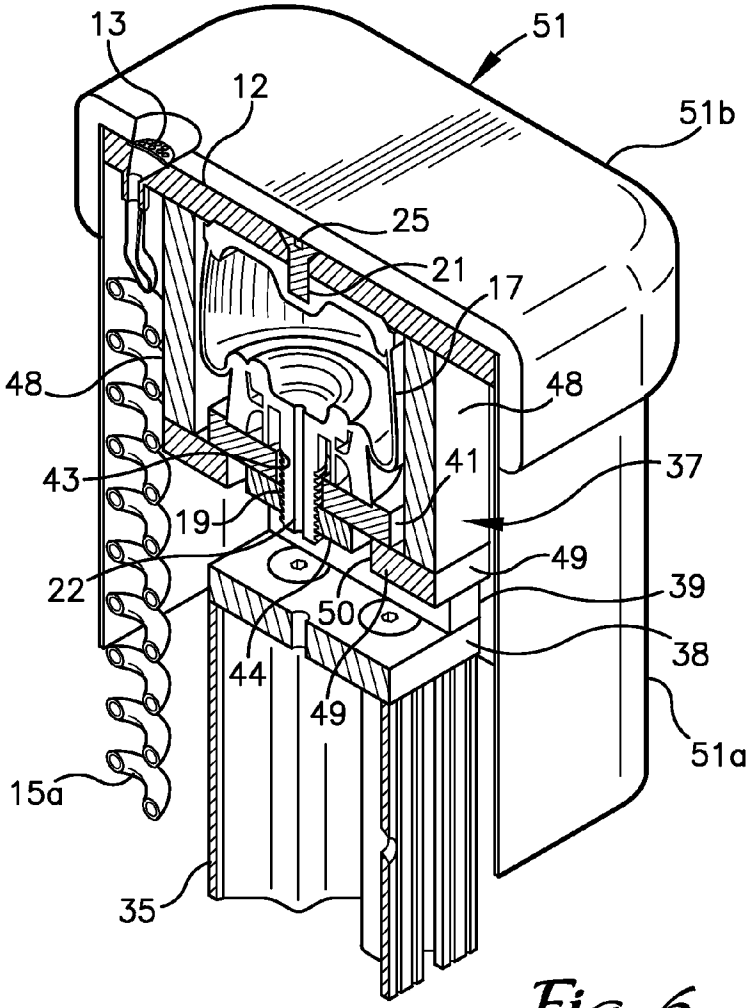
FIG. 6 is a cross sectional view of a first alternative embodiment of the seat pad taken generally along line 6-6 in FIG. 1.

When any given one of the pads 11 is in the retracted position, the body surface of the user which would normally rest on that pad 11 becomes exposed and can be washed. Washing is accomplished by spraying the body surface with a body wash and water mixture from one or more seat nozzles 13 directed toward the body surface and later rinsing the body surface with a spray of rinse water. The seat nozzles 13 may be mounted in the pads 11 (as shown in FIG. 6) or may be mounted in the seat 5 external of the pads 11 (as shown in FIGS. 1-4).

Referring to FIGS. 1-4, the seat pads 11*a*-11*d* each have a respective seat nozzle 13 mounted on the shower seat 5 adjacent thereto, the nozzles being denominated as seat nozzles 13*a*-13*d*, respectively. Each seat nozzle 13 is mounted in position to spray past the respective pad 11 when the pad 11 is retracted, in order to wash the body surface that would rest on the pad 11 when it is in its extended position. Two interstitial seat nozzles 14*a* and 14*b* are provided on the seat 5 generally between the pads 11*b* and 11*c* and are directed toward the groin and anal area of the user, respectively. The seat nozzles 13 and 14 are each connected to a water source 15 and to a source of liquid soap or body wash 16 (shown schematically in FIG. 8).

In the two pad embodiment of FIG. 7, the shower seat 5 includes nozzles 13*e* and 13*f* for spraying past seat pads 11*e* and 11*f* respectively as the pads 11*e* and 11*f* retract. Additional seat nozzles 14*c*-14*f* spray toward the thighs of the user.

The water source 15 may comprise a hose connected to the shower arm of the existing shower stall in place of the shower head. Water temperature may be controlled using the shower stall's existing mixing valve or valves. The source of body wash 16 is preferably a refillable reservoir mounted on the shower unit 1.

FIG. 6 shows an embodiment of the pad 11 having at least one seat nozzle 13 mounted in the pad 11 and positioned to direct a spray from the upper surface of the pad 11. The seat nozzle 13 is connected to the water source 15 and the source of liquid soap or body wash 16 through a coiled supply tube 15*a*. When a selected pad 11 is in the extended position, the respective seat nozzle 13 is turned off. As the pad 11 moves away from the user, the respective seat nozzle 13 sprays either soapy water or rinse water toward the user. The seat nozzle 13 is turned off before the pad 11 begins to move back toward the user.

Figure 5:
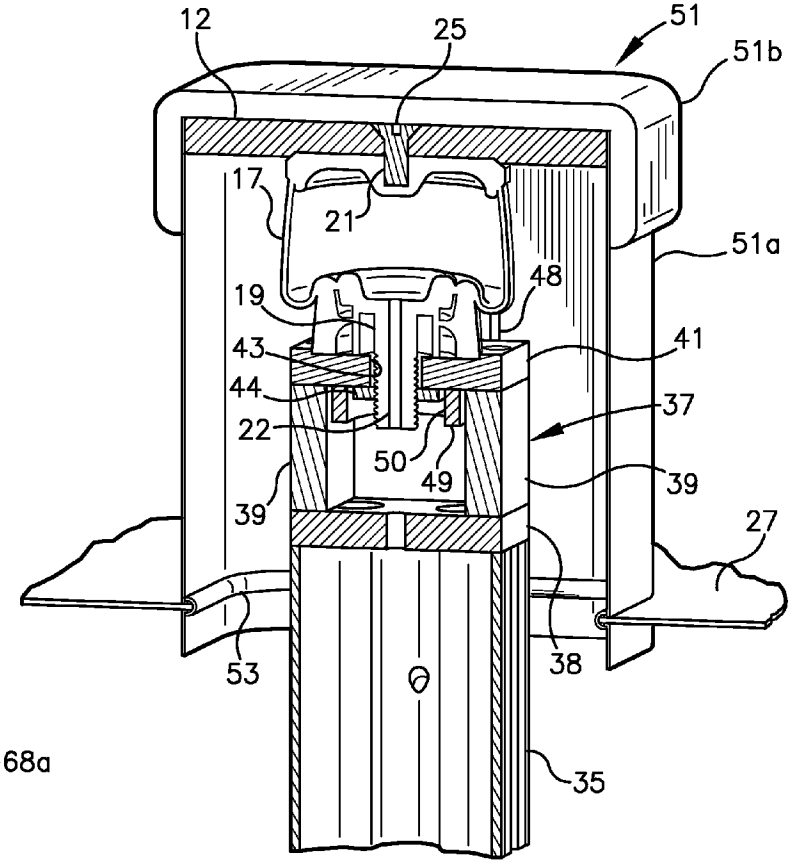
FIG. 5 is a cross sectional view of a seat pad which forms apart of the shower unit taken generally along line 5-5 in FIG. 1.

Referring to FIGS. 5 and 6, the pads 11 are each moved by respective linear actuators 17 and are controlled to move in a cyclical manner. Preferred actuators 17 are pneumatic air bags, such as Firestone® Airstroke® 1M1A-0 actuators. This actuator 17 includes a mounting stud 19 on its lower end and a bolt receiver 21 in its upper surface. The mounting stud 19 includes an internal passageway 22 which serves as the air inlet for the actuator 17. Each pad 11 moves through a stroke of approximately 25-32 mm.

Each pad 11 includes a pad plate 12 which is secured to the top of the respective actuator 17 by a bolt 25 received in the respective bolt receiver 21. The pad plates 12 (and, therefore, pads 11) are each shaped according to their position on the seat 5. The rear pads 11*b* and 11*c* are generally shaped to support the buttocks of the user, whereas the front pads 11*a* and 11*d* are sized and shaped to support the thighs of the user. It has also been found that for optimum balance, the front pads 11*a* and 11*d* should be spaced somewhat higher than the rear pads 11*b* and 11*c* when the pads 11 are in the extended position, for example 10-15 mm higher.

While pneumatic air bag actuators are the preferred actuators 17 for moving the pads 11, it is foreseen that other types of actuators, including hydraulic actuators and other types of pneumatic actuators may be used. It is foreseen that hydraulic actuators may be operated by water pressure.

Referring again to FIGS. 1-4, the base 3 may, for example, include a top wall 27, front wall 31, and a pair of side walls 33 connected along their edges to form a box-like structure defining an interior cavity. The base 3 includes an interior framework (not shown) providing support to the seat 5 and the walls 27, 31 and 33. The base 3 sits on adjustable feet 36. The walls 27, 31 and 33 may be integrally formed as a shroud that mounts over the interior framework. The front wall 31 is shown as including a knee slot 34 sized to receive a knee of an aide who may be required to help the user onto and off of the seat 5.

Referring again to FIGS. 5 and 6, the actuators 17 are each mounted on a respective post 35 which extends upwardly from the interior framework of the base 3 and through a respective opening in the top wall 27. Each actuator 17 is secured to the respective post 35 by a respective actuator mounting assembly 37. Each actuator mounting assembly 37 includes a base plate 38 which is secured to the respective post 35, a pair of spaced apart legs 39 which are connected to and extend upwardly from the base plate 38 and a cross piece 41 which is connected across the tops of the legs 39. Each cross piece 41 includes a center hole 43 for receiving the stud 19 of the respective actuator 17. A nut 44 is received on the stud 19 of each actuator 17 to secure the actuator 17 to the respective cross piece 41. Attached to each pad plate 12 are a pair of side plates 48 which extend downwardly therefrom on opposite sides of the respective cross piece 41. A keeper plate 49 connects the side plates 48 below the respective cross piece 41 and thereby limits upward movement of the respective pad 11. The keeper plate 49 includes an opening 50 which provides access to the air passageway 22 and allows connection of an air line (not shown) thereto.

Referring to FIGS. 5 and 6, the pads 11 are enclosed by a cover 51 formed of a flexible waterproof material, such as rubber. There may be a respective cover 51 for each of the pads 11, or multiple pads 11 may be covered by the same cover 51. For example, left and right pairs of the pads 11 could each share a cover 51, or a single cover 51 could be used to cover all of the pads 11. In the embodiment shown in FIGS. 5 and 6, each pad 11 is covered by a respective cover 51 which is formed in two pieces 51*a* and 51*b*. Cover section 51*a* is formed as a sleeve and slid around the assembly covering the sides. The lower end of cover section 51*na* mounts to the top wall 27 using a piece of C-channel trim 53 and adhesive. Cover section 51*b* is a separate cover for the top of the pad 11.

Figure 9:
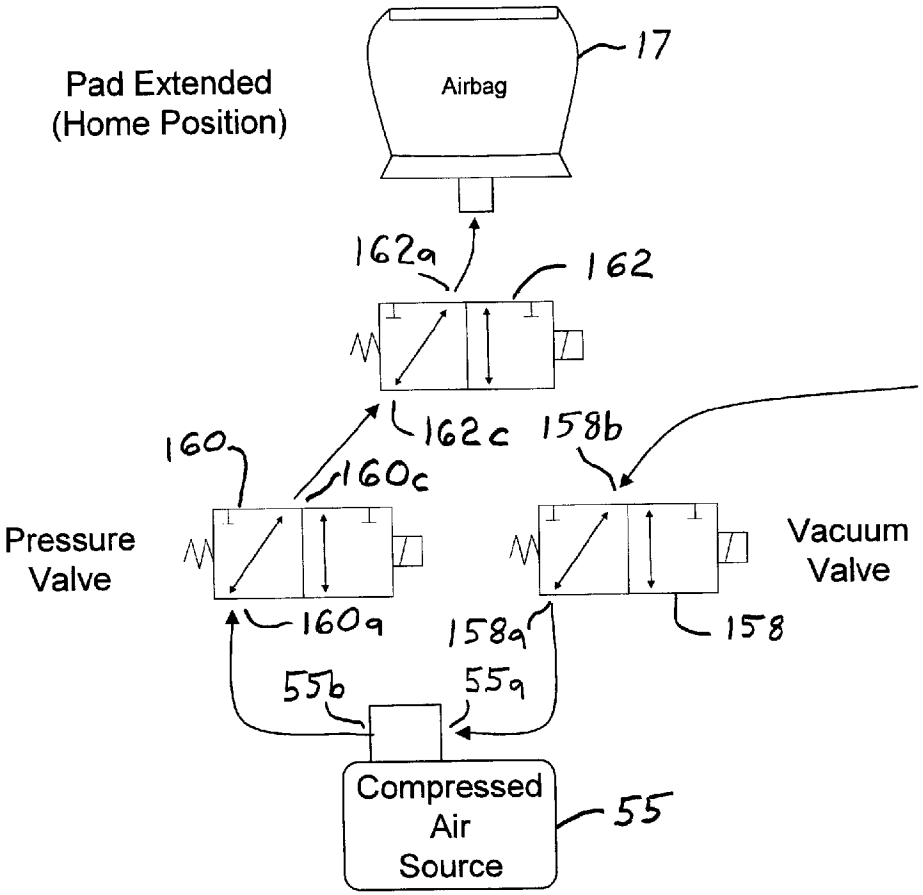
FIG. 9 is a schematic diagram showing a pneumatic circuit for extending a seat actuator.
Figure 10:
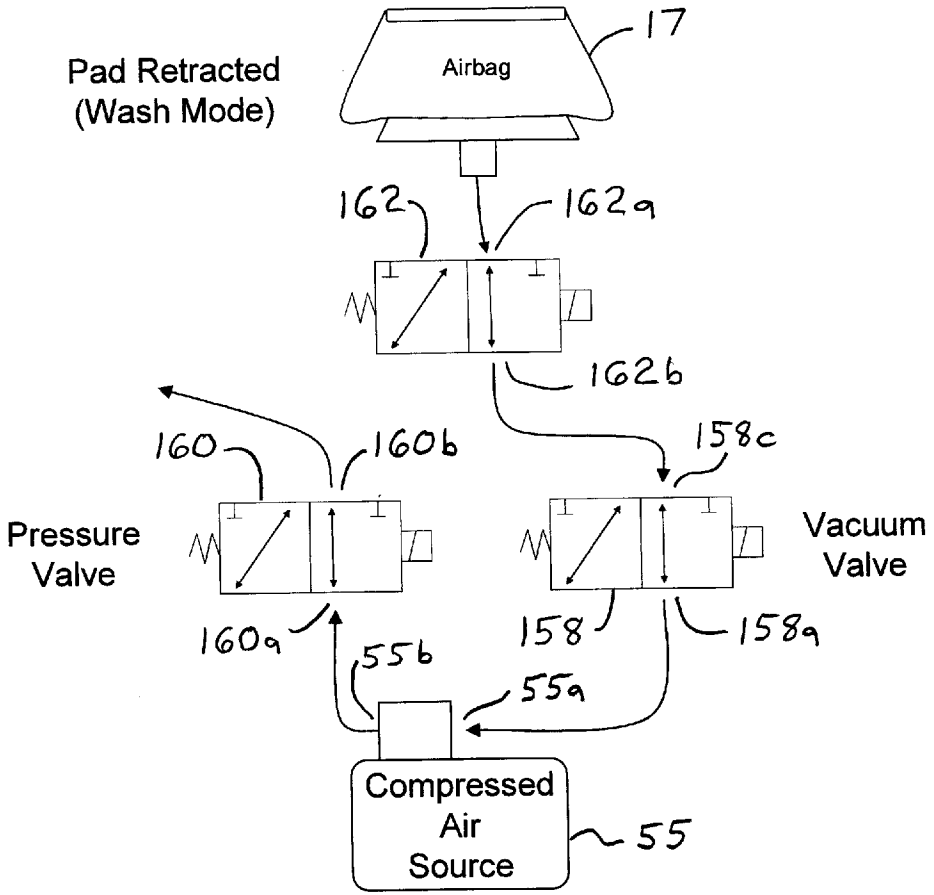
FIG. 10 is a schematic diagram showing a pneumatic circuit for retracting a seat actuator.

As shown schematically in FIGS. 9 and 10, the actuators 17 connected to the pads 11 are powered by an air compressor 55 acting through appropriate valving controlled by an electronic controller 57. Positive pressure is applied to the actuators 17 in order to cause them to extend and vacuum is applied to the actuators 17 in order to make them retract.

Figure 3:
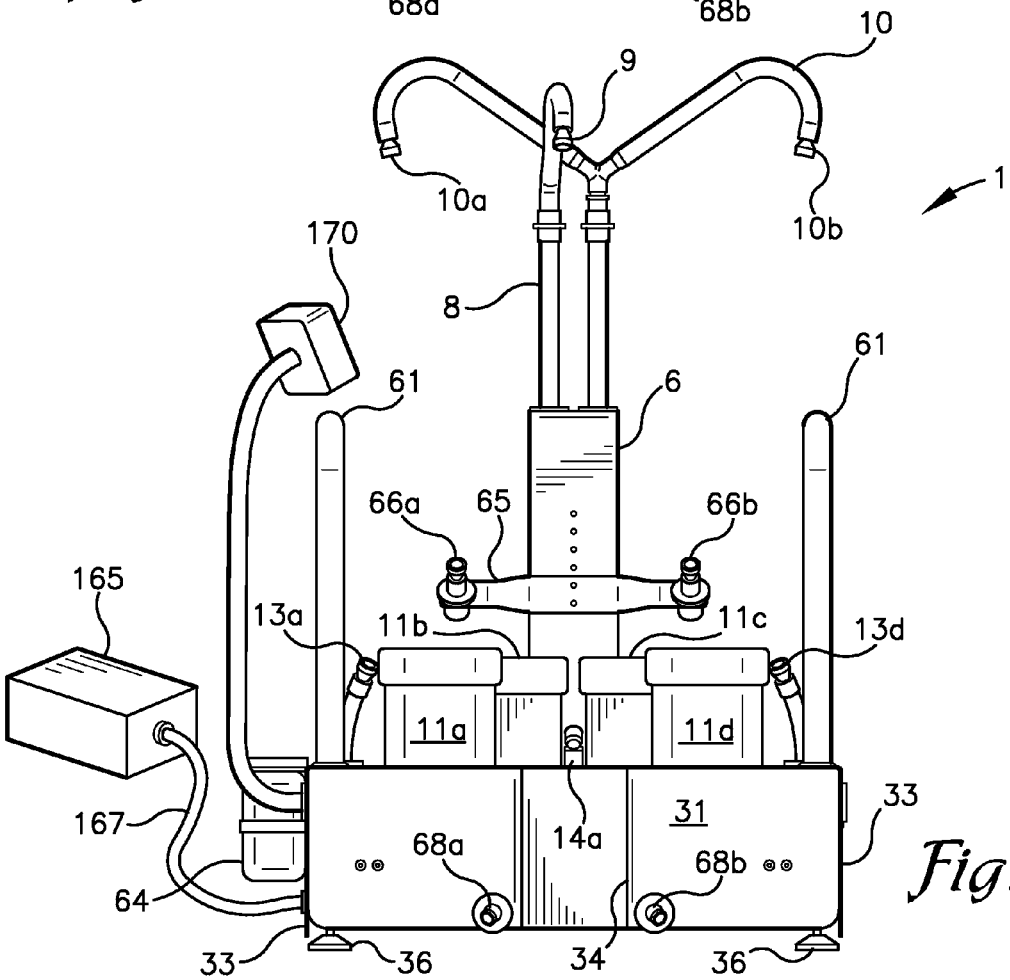
FIG. 3 is a front elevational view of the shower unit.
Figure 4:
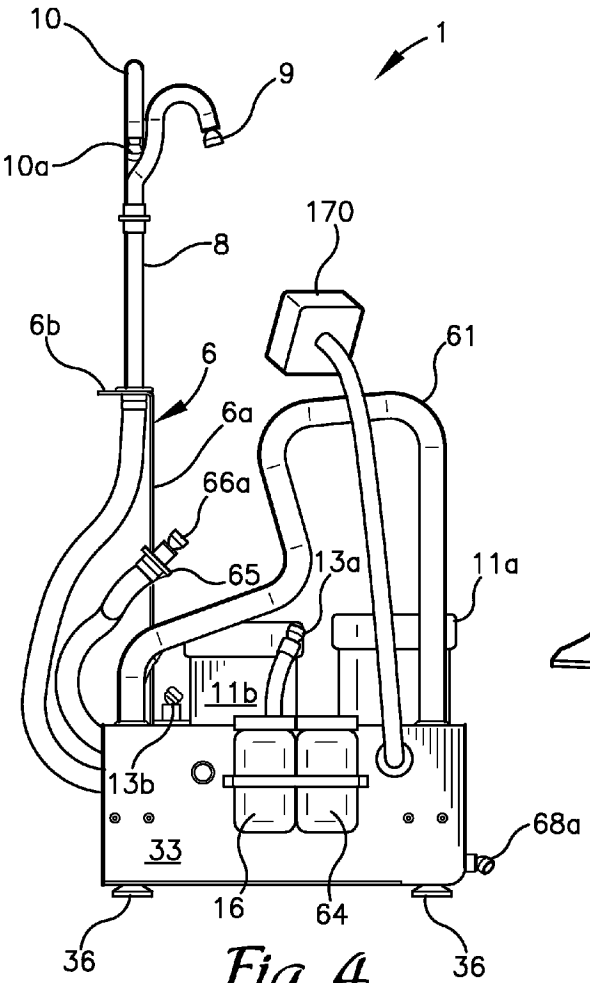
FIG. 4 is a side elevational view of the shower unit.

As best seen in FIGS. 3 and 4, the back support 6 may comprise a generally L-shaped plate having a first, longer leg 6*a* extending upwardly from the base 3. A second, shorter leg 6*b* extends rearwardly from the top of the first leg 6*a* and supports the shampoo assembly 8 and torso spray assembly 10. Respective grab bars 61 extend upwardly from the base 3 on opposite sides of the seat 5.

The shampoo assembly 8 and torso spray assembly 10 are mounted on the back support 6 and are both height adjustable to match the height of the user. The shampoo nozzle 9 is connected to the water source 15 and to a shampoo source 64. Also mounted on the back support 6 is a crosspiece 65 carrying laterally spaced underarm nozzles 66*a* and 66*b*, which are directed upwardly toward the underarms of a user seated on the seat 5. The crosspiece 65 is moveably mounted to the back support 6 for vertical adjustment to match the height of the user. The torso nozzles 10*a* and 10*b*, as well as the underarm nozzles 66*a* and 66*b* are connected to the water source 15 and the source of body wash 16.

Referring again to FIGS. 1-4, foot nozzles 68*a* and 68*b* extend outwardly through the front wall 31 of the base 3 in position to spray toward the feet of the user and are connected to the water source 15 and the source of body wash 16. Alternatively, the foot nozzles 68*a* and 68*b* may be mounted in foot rests (not shown) which could be shaped in the form of shallow bowls to serve as individual foot baths.

Additional spray nozzles may be mounted at any convenient location on the apparatus 1 in order to provide full body coverage for the user. For example, additional nozzles may be mounted in the seat 5 external from the seat pads 11, on the grab bars 61, on the back support 6, or on the front wall 31.

Figure 8:
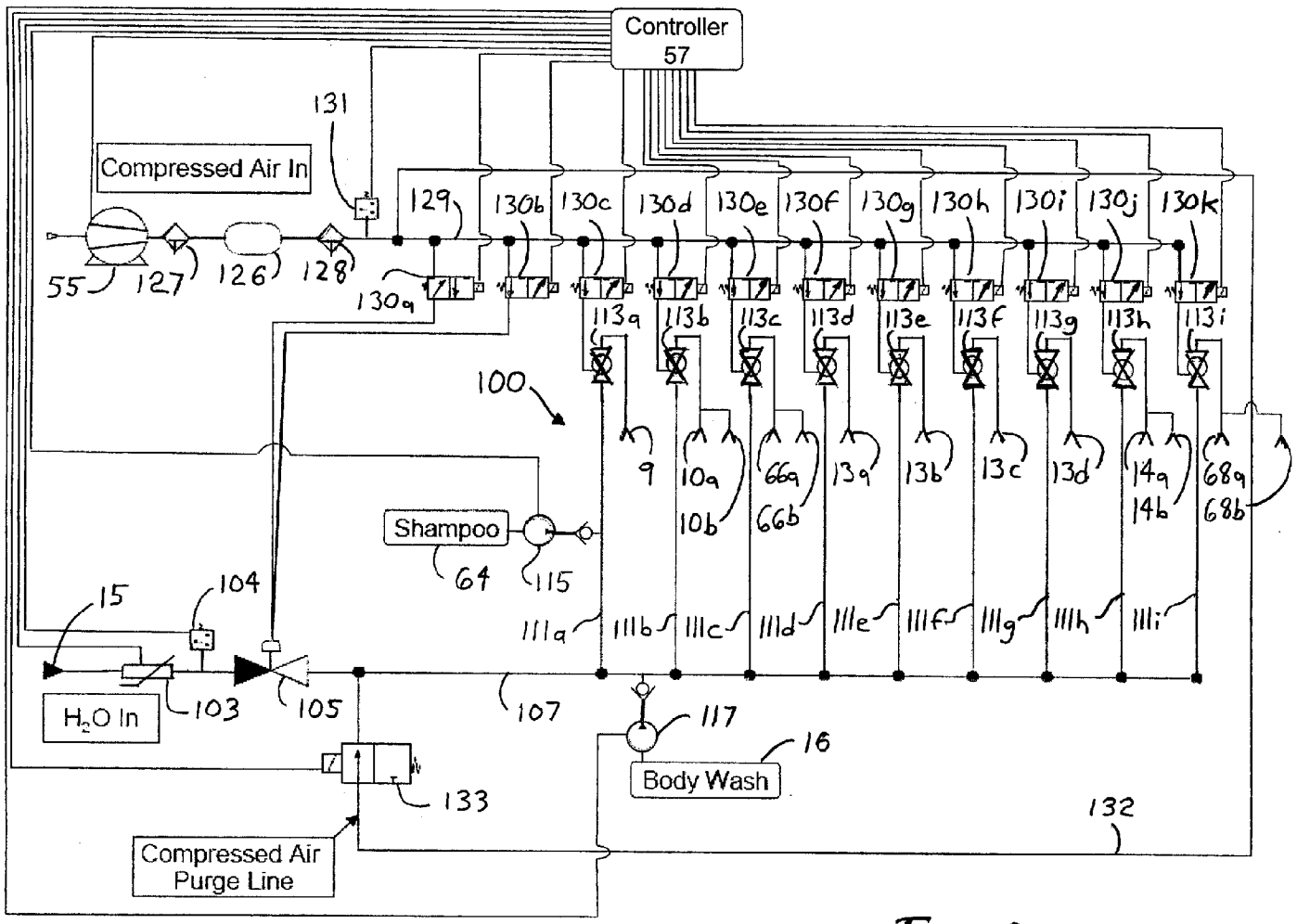
FIG. 8 is a schematic diagram of pneumatic and plumbing circuits of the shower unit.

FIG. 8 is a schematic diagram showing a water delivery system 100 for the shower unit 1 and pneumatic circuits associate therewith. Water enters the system from the water source 15. A water temperature sensor 103 and water pressure sensor 104 monitor the inlet water and send signals indicative of water pressure and temperature to the controller. An air operated two way ball valve 105 controls water flow into the system. From the ball valve 105, water flows into a main water line 107. Coming off the main water line 107 are a plurality of parallel branches 111, one branch 111 for each nozzle or set of nozzles in the system. Flow through each branch 111 to the respective nozzle or nozzles is controlled by a respective two way branch valve 113, which is preferably a pinch valve which is normally open and pressurized to close.

A first branch 111*a* provides water to the shampoo nozzle 9. Shampoo is selectively injected directly into the first branch 111*a* from the shampoo reservoir 64 by a shampoo pump 115. Flow of water or shampoo water mixture through the first branch 111*a* to the shampoo nozzle 9 is controlled by branch valve 113*a*.

After the first branch 111*a* branches off of the main line 107, body wash is selectively injected directly into the main line 107 from the body wash reservoir 16 by a body wash pump 117. The remaining branches 111 thus receive either water or body wash water mixture from the main line 107. A second branch 111*b* comes off of the main line 107 downstream of the body wash pump 117 and provides water or body wash water mixture to the torso nozzles 10*a* and 10*b*. Flow though the second branch 111*b* is controlled by branch valve 113*b*. A third branch 111*c* comes off the main line 107 and provides water or body wash water mixture to the underarm nozzles 66*a* and 66*b*. Flow through the third branch 111*c* is controlled by branch valve 113*c*.

The fourth through seventh branches 111*d*-111*g*, respectively, each come off of the main line 107 and each provide water or body wash water mixture to a respective one of the seat nozzles 13*a*-13*d*. Flow through each of the fourth through seventh branches is controlled by a respective branch valve 113*d*-113*g*. An eighth branch 111*h* comes off the main line 107 and provides water or body wash water mixture to the interstitial seat nozzles 14*a* and 14*b*. Flow through the eighth branch 111*h* is controlled by branch valve 113*h*. Lastly, a ninth branch 111*i* comes off the main line 107 and provides water or body wash water mixture to the foot nozzles 68*a* and 68*b*. Flow through the ninth branch 111*i* is controlled by branch valve 113*i*. It is foreseen that any additional nozzles could be supplied by additional parallel branches 111 and controlled by additional branch valves 113.

The pneumatic circuit of the shower unit 1 includes the compressor 55, a high pressure air tank 126, and appropriate water separators and filters 127 and 128, respectively. Air pressure is supplied from the air tank 126 through a compressed air line 129 to a series of three way solenoid valves 130*a*-130*k* which are operated by the controller 57. An air pressure sensor 131 monitors pressure in the line 129 and sends a signal to the controller 57 indicative of the pressure. Valves 130*a* and 130*b* selectively provides air pressure to open and close the two way ball valve 105. Valve 130*c* selectively provides air pressure to close branch valve 113*a* which controls flow to the shampoo nozzle 9 or vents pressure to open the valve 113*a*. Valve 130*d* selectively provides air pressure to close branch valve 113*b* which controls flow to the torso nozzles 10*a* and 10*b* or vents pressure to open the valve 113*b*. Valve 130*e* selectively provides air pressure to close branch valve 113*c* which controls flow to the underarm nozzles 66*a* and 66*b* or vents pressure to open the valve 113*c*.

Valves 130*f*-130*i* each provide air pressure to close a respective one of the branch valves 113*d*-113*g* which control flow to nozzles 13*a*-13*d* in the seat pads 11*a*-11*d* or vent pressure to open the respective valve 113*d*-113*g*. Valve 130*j* selectively provides air pressure to close branch valve 113*h* which controls flow to the interstitial seat nozzles 14 or vents pressure to open the valve 113*h*. Valve 130*k* selectively provides air pressure to close branch valve 113*i* which controls flow to the foot nozzles 68*a* and 68*b* or vents pressure to open the valve 113*i*. The shampoo pump 115 and body wash pump 117 are DC electric motor driven pumps and are turned on and off as required by the controller 57.

With continued reference to FIG. 8, the shower unit 1 also provides means to purge all of the fluid lines, nozzles and valves of water, body wash and shampoo after use. This is important to prevent any build up of mold or bacteria in the unit 1. The system is first rinsed with clean water utilizing the plumbing circuit previously described, and then purged with compressed air to remove the water. In order to facilitate the air purge, a purge line 132 is provided from the compressed air line 129 to the main water line 107 proximate the ball valve 105. Flow through the purge line 132 is controlled by a two way solenoid purge valve 133 operated by the controller 57. The purge line 132 allows the controller 57 to use compressed air to purge substantially all liquids from the system after use.

Rinsing and purging are both preferably accomplished on a zone-by zone basis, starting with the highest nozzles and their associated plumbing and working downwardly.

After the user completes his or her shower, the system is first rinsed with clean water to remove shampoo and body wash residue from the system. With the shampoo pump 115 and body wash pump 117 turned off and the ball valve 105 open, the controller opens branch valve 113*a* to flush clean water through the first branch 111*a*, including the valve 113*a* and the shampoo nozzle 9. Next, valve 113*a* is closed and valve 113*b* is opened to rinse the second branch 111*b*, including the valve 113*b* and torso nozzles 10*a* and 10*b*. The process is repeated sequentially for each branch 111 until all branches 111 have been rinsed of shampoo or body wash.

Once the rinse cycle is completed, the system will be substantially free of shampoo and body wash residue, but will still contain standing water. In order to purge the system of standing water, the zone-by-zone process is repeated using compressed air supplied to the water line 107 through the purge line 132. To begin the purging process, the controller 57 first calls for the compressor 55 to build up to full pressure of 82 psi. The controller then causes the purge valve 133 and branch valve 113*a* to open for approximately five seconds to allow compressed air to flow through the first branch 111*a* and force all remaining water out of the first branch 111*a* through the shampoo nozzle 9. Next, purge valve 133 and branch valve 113*a* are closed and the compressor 55 is allowed to rebuild pressure. The purge valve 133 and branch valve 113*b* are then opened allowing compressed air to flow through the second branch 111*b* and force the remaining water out through the torso nozzles 10*a* and 10*b*. The process is repeated sequentially for each branch 111 until all branches 111 have been purged of water. When the last branch 111, branch 111*i*, has been purged of water, the compressor 55 is shut off. The purge valve 133 and branch valve 113*i* are held open until air pressure at the sensor 131 drops to 5 psi. This prevents any compressed air from being trapped in the water system.

Referring to FIGS. 9 and 10, compressor 55 is connected to the seat actuators 17 through a vacuum valve 158 and a pressure valve 160 in order to provide both positive pressure to raise the seat pads 11 and vacuum to lower the seat pads 11. A three way actuator valve 162 is provided for each of the actuators 17. Each actuator valve 162 acts to communicate the respective actuator 17 to either the vacuum valve 158 or the pressure valve 160 and includes an actuator port 162*a* connected to the respective actuator 17, a vacuum port 162*b* connected to the vacuum valve 158 and a pressure port 162*c* connected to the pressure valve 160. The vacuum valve 158 is a three way solenoid valve having an outlet 158*a* connected to the suction side 55*a* of the compressor 55, a first inlet 158*b* open to the atmosphere, and a second inlet 158*c* connected to the vacuum ports 162*b* of the actuator valves 162. The pressure valve 160 is also a three way solenoid valve having an inlet 160*a* connected to the discharge side 55*b* of the compressor 55, a first outlet 160*b* open to the atmosphere, and a second outlet 160*c* connected to of the pressure ports 162*c* of the actuator valves 162.

Referring to FIG. 9, when the pads 11 and their respective actuators 17 are extended, the vacuum valve 158, pressure valve 160, and the respective actuator valves 162 are all de-energized. Each actuator valve 162 places the respective actuator 17 in communication with the pressure valve 160 through its pressure port 162*c*. In series, the pressure valve 160 communicates the actuator 17 with the discharge side 55*b* of the compressor 55 through its inlet port 160*a*, thereby supplying compressed air to the actuator 17 and extending the pad 11. The vacuum valve 158 communicates the suction side 55*a* of the compressor 55 with the atmosphere. The extended position is the home position of the pads 11 and the respective actuators 17 remain in the extended state until it is desired to retract a particular pad 11 in order for the respective nozzle 13 to spray past it.

Referring to FIG. 10, when it is desired to retract a particular pad 11, the vacuum valve 158, pressure valve 160, and the respective actuator valve 162 are all energized. The actuator valve 162 places the actuator 17 in communication with the vacuum valve 158 through its vacuum port 162*b*. In series, the vacuum valve 158 communicates the actuator 17 with the suction side 55*a* of the compressor 55 through its inlet port 158*a*, thereby supplying vacuum to the actuator 17 and retracting the pad 11. The pressure valve 160 communicates the discharge side 55*b* of the compressor 55 with the atmosphere. Placed in communication with vacuum, the actuator 17 retracts and moves the respective pad 11 to its retracted position, allowing the respective nozzle 13 to spray past it.

The air compressor 55, tank 126, valves 105, 113, 130, 133, 158, 160 and 162, pumps 115 and 117, controller 57 and other hardware may be housed in the interior cavity of the base 3. Alternatively, as shown in FIG. 3, some of the components may be placed in a separate box or power pack 165 connected to the unit 1 by an umbilical 167. For example, the compressor 55, vacuum valve 158 and pressure valve 160, along with a AC to DC power converter may be mounted in the power pack 165 with respective pressure, vacuum and DC power lines running through the umbilical 167.

The controller 57 is programmed to operate the air compressor 55, valves 105, 113, 130, 133, 158, 160 and 162, and pumps 115 and 117 with input from a user interface 170, which may be, for example, a touch screen interface which can be mounted inside or outside of the shower area. Alternatively, the user interface 170 may be voice activated.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

As used herein, the term "body wash" is intended to mean any type of water soluble cleaning agent acceptable for use in cleaning human skin, including soap. The term "cleaning agent" is intended to include both body washes and shampoo.

It is also to be understood that the pressure and vacuum sources for operating the shower unit 1 could be sources other than the single stand-alone compressor 55 disclosed herein. For example, in an institutional setting such as a hospital, rehabilitation center, or elder care facility, the building may be equipped with house air systems which could be connected to the unit 1. It is also foreseen that a separate vacuum pump could be used in the shower unit 1 to retract the actuators 17 rather than taking vacuum off of the suction side of the compressor 55.

What is claimed and desired to be secured by Letters Patent is as follows:

1. A shower unit for washing a human user, the shower unit comprising:

a) a water source;

b) a water delivery system connected to said water source, said water delivery system including at least one output nozzle;

c) a main valve operable to shut off flow into said water delivery system;

d) injection means for selectively injecting at least one cleaning agent into said water delivery system to produce a cleaning agent/water solution;

e) a compressed air source;

f) a purge line connecting said compressed air source to said water delivery system; and g) a purge valve controlling air flow through said purge line; wherein:

h) with said main valve closed and said purge valve open, compressed air is allowed to flow through said water delivery system to purge any water through said at least one output nozzle.

2. The shower unit as in claim 1 wherein said water system includes a main line and a plurality of parallel branches coming off of said main water line, each said branch having at least one said output nozzle and a branch valve controlling flow through the respective branch.

3. The shower unit as in claim 2 wherein with said main valve closed and said purge valve open, said branch valves may be opened one at a time to allow compressed air to flow through the respective branch and purge any water in said respective branch through the respective at least one output nozzle.

4. The shower unit as in claim 2 wherein said branch valves are air operated valves in selective communication with said compressed air source.

5. The shower unit as in claim 2 wherein said injection means includes a shampoo pump selectively injecting shampoo into a first branch of said parallel branches and the respective at least one output nozzle is positioned to spray downwardly on the head of a human user in the shower unit.

6. The shower unit as in claim 5 wherein said injection means further includes a body wash pump selectively injecting body wash into said main line downstream of said first branch and wherein the output nozzles associated with ones of said branches downstream of said first branch are positioned to spray onto body surfaces of the human user in the shower unit.

7. The shower unit as in claim 6 and further including a shower seat supporting the human user in the shower unit in a seated position.

8. The shower unit as in claim 7 wherein at least one of said output nozzles positioned to spray onto body surfaces of the user in the shower unit is mounted in said shower seat for spraying toward lower body surfaces of the human user in the shower unit supported in a seated position.

9. The shower unit as in claim 1 wherein said injection means further acts to selectively shut off the flow of cleaning agent into said water delivery system with said main valve open to allow clean water to rinse the cleaning agent/water solution from said water delivery system.

10. A shower unit for washing a human user, the shower unit comprising:

a) a water source;

b) a water delivery system connected to said water source, said water delivery system including a main water line and a plurality of parallel branches coming off of said main water line, each said branch having at least one output nozzle;

c) a compressed air source;

d) for each said branch, a respective air operated branch valve controlling flow through the respective branch, each said air operated valve in selective communication with said compressed air source;

e) a main valve operable to shut off flow from said water source to said main water line;

f) a purge line connecting said compressed air source to said main water line; and g) a purge valve controlling air flow through said purge line; wherein:

h) with said main valve closed and said purge valve open, said branch valves may be opened one at a time to allow compressed air to flow through the respective branch and purge any water in said respective branch through the respective at least one output nozzle.

11. The shower unit as in claim 10 wherein a first branch of said parallel branches further includes a shampoo pump selectively injecting shampoo into said first branch and the respective at least one output nozzle is positioned to spray downwardly on the head of a human user in the shower unit.

12. The shower unit as in claim 11 wherein said main line further includes a body wash pump selectively injecting body wash into said main water line downstream of said first branch and wherein the output nozzles associated with ones of said branches downstream of said first branch are positioned to spray onto body surfaces of the human user in the shower unit.

13. The shower unit as in claim 12 and further including a shower seat supporting the human user in the shower unit in a seated position.

14. The shower unit as in claim 13 wherein at least one of said output nozzles positioned to spray onto body surfaces of the user in the shower unit is mounted in said shower seat for spraying toward lower body surfaces of the human user in the shower unit supported in a seated position.

15. A method of purging water from a shower unit after use, the shower unit having a water system comprising a main water line dividing into a plurality of parallel branches, each branch terminating in at least one respective output nozzle and flow through each branch controlled by a respective branch valve, the output nozzles positioned at varying heights, the method comprising the steps of:

a) shutting off water flow into the main water line;

b) introducing compressed air into the main water line at a selected purge pressure;

c) opening one of the branch valves while keeping the remainder of the branch valves closed and allowing the compressed air to force any water in the respective branch out through the respective at least one output nozzle;

d) closing the previously opened branch valve;

e) repeating said opening and closing steps for each branch valve in the shower unit until all but one of the branches have been purged of water;

f) opening the last branch valve while keeping the remainder of the branch valves closed and allowing the compressed air to force any water in the respective branch out through the respective at least one output nozzle; and g) shutting off the flow of compressed air entering the main water supply line while keeping the last branch valve open and allowing air pressure in said main water line to drop below a preselected shut-down pressure; wherein h) said opening and closing steps begin with the branch valve controlling the branch with the highest positioned at least one output nozzle and proceed downwardly such that the last branch valve is the branch valve controlling the branch with the lowest positioned at least one output nozzle.

16. The method as in claim 15 wherein the compressed air is supplied by an air compressor connected to said main water line by a purge line and flow through the purge line is controlled by a purge valve, said step of closing the previously opened branch valve and each repetition of said closing step further including:

a) closing the purge valve, and b) allowing the compressor to build air pressure until a measured air pressure at the compressor reaches the purge pressure before repeating said step of opening one of the branch valves.

17. The method as in claim 16 wherein said step of shutting off the flow of compressed air includes turning off the compressor while keeping the purge valve and last branch valve open and measuring the air pressure at the compressor to determine when said shut-off pressure has been reached.

18. The method as in claim 15 for use wherein a cleaning agent has been introduced into the water system of the shower unit during use and further including, before said step of shutting off water flow into the main water line, the steps of:

a) shutting off any flow of cleaning agents into the water system;

b) with water flowing into said main water line, opening one of the branch valves while keeping the remainder of the branch valves closed and allowing incoming water to rinse any cleaning agent in the respective branch out through the respective at least one output nozzle;

c) closing the previously opened branch valve; and d) repeating said steps of opening and closing the branch valves with water flowing into the main water line for each branch valve in the shower unit until all of the branches have been rinsed of cleaning agent.

19. The method as in claim 18 wherein said steps of opening and closing the branch valves with water flowing into the main water line begin with the branch valve controlling the branch with the highest positioned at least one output nozzle and proceed downwardly such that the last branch valve is the branch valve controlling the branch with the lowest positioned at least one output nozzle.

20. A method of purging water from a shower unit after use, the shower unit having a water system comprising a main water line dividing into a plurality of parallel branches, and means for introducing a cleaning agent into the water system, each branch terminating in at least one respective output nozzle and flow through each branch controlled by a respective branch valve, the method comprising the steps of:

a) after a cleaning agent has been introduced into the water system, shutting off flow of cleaning agents into the water system;

b) with water flowing into said main water line, opening one of the branch valves while keeping the remainder of the branch valves closed and allowing incoming water to rinse any cleaning agent in the respective branch out through the respective at least one output nozzle;

c) closing the previously opened branch valve;

d) repeating said steps of opening and closing the branch valves with water flowing into the main water line for each branch valve in the shower unit until all of the branches have been rinsed of cleaning agent;

e) after all of the branches have been rinsed of cleaning agent, shutting off water flow into the main water line;

f) introducing compressed air into the main water line at a selected purge pressure;

g) opening one of the branch valves while keeping the remainder of the branch valves closed and allowing the compressed air to force any water in the respective branch out through the respective at least one output nozzle;

h) closing the previously opened branch valve;

i) repeating said opening and closing steps for each branch valve in the shower unit until all but one of the branches have been purged of water;

j) opening the last branch valve while keeping the remainder of the branch valves closed and allowing the compressed air to force any water in the respective branch out through the respective at least one output nozzle; and k) shutting off the flow of compressed air entering the main water supply line while keeping the last branch valve open and allowing air pressure in said main water line to drop below a preselected shut-down pressure.

21. The method as in claim 20 wherein the output nozzles in the shower unit are positioned at varying heights and said steps of opening and closing the branch valves with water flowing into the main water line begin with the branch valve controlling the branch with the highest positioned at least one output nozzle and proceed downwardly such that the last branch valve is the branch valve controlling the branch with the lowest positioned at least one output nozzle.

22. The method as in claim 20 wherein the output nozzles in the shower unit are positioned at varying heights and said opening and closing steps after said step of shutting off water flow into the main water line begin with the branch valve controlling the branch with the highest positioned at least one output nozzle and proceed downwardly such that the last branch valve is the branch valve controlling the branch with the lowest positioned at least one output nozzle.

23. The method as in claim 20 wherein the compressed air is supplied by an air compressor connected to said main water line by a purge line and flow through the purge line is controlled by a purge valve, said step of closing the previously opened branch valve after shutting off water flow into the main water line and each repetition of said closing step after shutting off water flow into the main water line further including:

a) closing the purge valve, and b) allowing the compressor to build air pressure until a measured air pressure at the compressor reaches the purge pressure before repeating said step of opening one of the branch valves.

24. The method as in claim 23 wherein said step of shutting off the flow of compressed air includes turning off the compressor while keeping the purge valve and last branch valve open and measuring the air pressure at the compressor to determine when said shut-off pressure has been reached.

* * * * *